United States Patent [19]

Kamitani et al.

[11] Patent Number: 4,591,416

[45] Date of Patent: May 27, 1986

[54] CHROMATE COMPOSITION AND PROCESS FOR TREATING ZINC-NICKEL ALLOYS

[75] Inventors: Masaaki Kamitani, Tokyo; Hidenori Tsuji, Kanagawa, both of Japan

[73] Assignee: Ebara-Udylite Co., Ltd., Tokyo, Japan

[21] Appl. No.: 455,622

[22] Filed: Jan. 4, 1983

[51] Int. Cl.[4] ..... C25D 11/38; C23C 22/24

[52] U.S. Cl. ..... 204/35.1; 148/6.21; 204/38.1; 204/40

[58] Field of Search ..... 204/35.1, 38.1, 40, 204/43.2; 148/6.2, 6.21

[56] References Cited

U.S. PATENT DOCUMENTS

| | | | |
|---|---|---|---|
| 3,855,010 | 12/1974 | Sharmaitis et al. | 148/6.21 |
| 3,895,969 | 7/1975 | Miller | 148/6.2 |
| 4,216,272 | 8/1980 | Clauss | 428/632 |
| 4,266,988 | 5/1981 | Krippes | 148/6.21 |
| 4,388,160 | 6/1983 | Rynne | 204/38 R |

OTHER PUBLICATIONS

H. Silman et al., *Protective and Decorative Coatings for Metals,* Finishing Publications Ltd., Teddington, Middlesex, England, 1978, pp. 433–435.

A. K. Graham, *Electroplating Engineering Handbook,* 2nd edition, Reinhold Publishing Corp., New York, 1962, pp. 419–420.

*Primary Examiner*—John F. Niebling
*Assistant Examiner*—William T. Leader
*Attorney, Agent, or Firm*—Richard P. Mueller

[57] ABSTRACT

The present invention includes an aqueous acidic chromate solution, suitable for forming colored chromate coatings on zinc-nickel alloy electrodeposits containing up to about 15% by weight nickel, which solutions have a pH within the range of about 1.3 to about 2.7, a hexavalent chromium concentration of at least 0.5 grams per liter, and preferably about 0.5 to about 100 grams per liter, and which contain sulfate in a weight ratio of $SO_4:Cr^{+6}$ of about 0.025–1.5:1.

The zinc-nickel alloy electrodeposits are preferably immersed in the chromating solution for a period sufficient to form the desired colored chromate coating. In some instances, a flash electrodeposit of zinc may be applied to the zinc-nickel alloy electrodeposit before it is immersed in the chromating solution. Alternatively, the zinc-nickel alloy electrodeposit may be immersed in the chromating solution and the solution electrolyzed, with the zinc-nickel alloy surface as the anode, at low current densities for a short period of time, after which, the electrolysis is discontinued and the zinc-nickel alloy surface is maintained in the chromating solution until the desired colored chromate film is formed.

4 Claims, No Drawings

CHROMATE COMPOSITION AND PROCESS FOR TREATING ZINC-NICKEL ALLOYS

This invention relates to a composition and process for forming colored chromate coatings on zinc-nickel alloy surfaces and, more particularly, relates to compositions and processes for forming colored chromate coatings on electrodeposited zinc-nickel alloy surfaces to provide a composite coating having improved corrosion resistance as compared to that obtained with zinc electrodeposits.

BACKGROUND OF THE INVENTION

The use of zinc electrodeposits on iron or steel substrates to provide improved corrosion protection has long been practiced. Although such zinc electrodeposits greatly enhance the corrosion resistance of the iron or steel substrate, the zinc itself forms white "rust" or corrosion which, ultimately, can result in the corrosion of the iron or steel substrate itself with the consequent formation of red rust. To minimize this and improve the corrosion resistance of the zinc electroplated substrates, it has commonly been the practice to treat such surfaces with an acidic, hexavalent chromium containing solution to form a visible or colored chromate passivating film on the surface. Typical compositions and process for forming such chromate passivating films are disclosed in U.S. Pat. Nos. 2,021,592; 2,106,904; 2,288,007; 2,376,158; 2,939,664; 2,610,133; 2,760,891; 3,090,710; 3,404,046; and 3,895,969.

Recently, considerable work has been done to improve the corrosion resistance of zinc electroplated substrates by the substitution of zinc alloy electrodeposits for the substantially pure zinc electrodeposits which have heretofore been used. Although various different metals have been used with the zinc in such alloy electrodeposits, particularly good results, in terms of the improvements in corrosion resistance and the brightness or gloss of the surface, have been obtained with zinc-nickel alloy electrodeposits. Depending upon the nickel content of such zinc-nickel alloy electrodeposits, the time for the formation of red rust in salt spray testing can be as much as five to ten times greater than the time for such red rust formation with zinc electrodeposits. In spite of this, the formation of white rust or corrosion on such zinc-nickel alloy deposits is still a problem which must be minimized by the application of a chromate or other passivating film.

It has been found, however, that the formation of a colored or visible chromate film having high corrosion resistance on such zinc-nickel alloy electrodeposits is much more difficult than on zinc electrodeposits. In the various patents disclosed hereinabove, there is no specific disclosure of the treatment of zinc-nickel alloy electrodeposits, although the treatment of zinc alloy deposits, broadly, is mentioned. Generally, the chromating compositions of these patents have not been effective in producing a satisfactory corrosion resistant chromate film on zinc-nickel alloy electrodeposits. For example, in U.S. Pat. No. 2,106,904, there is disclosed a chromic acid/sulfuric acid solution which contains from about 13 to 104 g/l hexavalent chromium and from about 1.8 to 144 g/l $SO_4$, with a weight ratio of hexavalent chromium: $SO_4$ of 0.09–59:1. This solution is specified as having a pH which is not in excess of 1.0, and when used for the treatment of zinc-nickel alloy electrodeposits, the resulting chromate film has relatively poor corrosion resistance. This difficulty in forming colored chromate film with high corrosion resistance on the zinc-nickel alloy electrodeposits is one reason why such deposits have not been more widely adopted as a replacement for zinc electrodeposits for the production of decorative and corrosion resistant coatings on iron and steel substrates.

It is, therefore, an object of the present invention to provide an improved chromating composition which will produce excellent colored, corrosion resistant coatings on zinc-nickel alloy electrodeposits.

A further object of the present invention is to provide an improved process for the formation of colored, corrosion resistant chromate films on zinc-nickel alloy electrodeposits.

These and other objects will become apparent to those skilled in the art from the description of the invention which follows.

SUMMARY OF THE INVENTION

Pursuant to the above objects, it has now been found that excellent colored, corrosion resistant coatings can be formed on zinc-nickel alloy electrodeposits containing up to about 15% by weight nickel, by treating such electrodeposits with an aqueous acidic solution having a pH of from about 1.3 to about 2.7, which solution comprises hexavalent chromium in an amount of, at least about 0.5 g/l and sulfate in a weight ratio of $SO_4$:$Cr^{+6}$ of about 0.025–1.5:1. Typically, such zinc-nickel alloy electrodeposits are immersed in this aqueous acidic chromating solution for a period of time sufficient to form the desired corrosion resistant chromate film on the alloy surface. Alternatively, the improved corrosion resistant colored chromate film may be formed by electrolysis of the zinc-nickel alloy electrodeposit in the chromating solution, using a relatively weak electric current with the zinc-nickel alloy surface as the anode prior to the immersion treatment. In some instances, it has also been found to be desirable to apply a thin or "flash" electrodeposit of zinc on the zinc-nickel alloy surface before it is treated with the chromating solution.

The thus-formed chromated coatings are found to provide excellent corrosion resistance to both white rust and red rust on zinc-nickel alloy electroplated substrates. Additionally, it has been found that the heat resistance to color fading of such films has also been increased.

DETAILED DESCRIPTION OF THE INVENTION

The improved chromating solutions of the present invention are aqueous acidic solutions having a pH of from about 1.3 to about 2.7 and comprising hexavalent chromium ($Cr^{+6}$) in an amount of at least 0.5 g/l and sulfate ($SO_4$) in a weight ratio of $SO_4$:$Cr^{+6}$ of about 0.025–1.5:1. Although the maximum concentration of the hexavalent chromium in this solution has not been found to be critical, amounts up to the maximum saturation of hexavalent chromium in the solution being suitable, where high hexavalent chromium concentraitons are used, the cost of the process is increased and additional treatment of the waste or rinse water is often necessary in order to meet environmental standards. In general, it has been found that the use of hexavalent chromium concentrations in excess of about 100 g/l does not provide any significant and further improvement in the corrosion resistance of the chromate film. Accordingly, from the standpoint of practical considerations, hexavalent chromium concentrations in the present chromating solutions of from about 0.5 to about 100 g/l are preferred. Where hexavalent chromium concentrations below about 0.5 g/l are used, the resulting chromate film becomes relatively thin and sufficient corrosion resistance is, generally, not obtained.

It has been found to be important in the improved chromating solutions of the present invention, to maintain the weight ratio of $SO_4:Cr^{+6}$ within the specified range of from 0.025–1.5:1, preferably 0.05–1.0:1. Where the sulfate to hexavalent chromium ratio is below about 0.025, the desired colored chromate film is not completely formed on the zinc-nickel alloy electrodeposit. Moreover, where the ratio of sulfate to hexavalent chromium is in excess of about 1.5, the resulting chromate film is relatively thin and its corrosion resistance is undesirably low.

Similarly, it is important to maintain the pH of the present chromating solution within the prescribed range of about 1.3 to 2.7 preferably 1.4 to 2.2. It has been found that where the pH of the solution is below about 1.3, the resulting chromate film contains a relatively small amount of adherent chromium and, thus, has undesirably low corrosion resistance and an unsatisfactory color. This finding is somewhat surprising in that with the treatment of zinc electrodeposits, rather than zinc-nickel alloy electrodeposits, using a conventional chromate solution containing 100 g/l $CrO_3$ and 5 g/l $H_2SO_4$ with a pH of 0.5, a colored chromate film having good appearance and corrosion resistance is formed. It has further been found that when the pH of the present chromating solutions is in excess of about 2.7, the reactivity of the chromating solution is reduced and a colored chromate film having good appearance and corrosion resistance is not formed on the zinc-nickel alloy electrodeposit.

The improved chromating solutions of the present invention may be formulated using any bath soluble hexavalent chromium and sulphate compounds, the anions or cations of which are not detrimental to the chromating solution or the chromate film subsequently formed on the zinc-nickel alloy surface. Typical of the compounds which may be used are chromic acid, sulfuric acid, the alkali metal chromates and dichromates, metallic sulfates, such as zinc sulphate and chromium sulphate, and the like. In this latter regard, it has been found that in some instances, the inclusion of trivalent chromium, typically added as chromium sulphate, may be beneficial in the formation of the desired corrosion resistant chromate film. Even where trivalent chromium is not added to the bath as it is initially made up, it will typically be formed in the bath by reduction of the hexavalent chromium during use.

To adjust the pH of the present chromating solutions, acids, such as chromic acid or sulfuric acid, are typically used where a reduction in the pH is desired. Where the pH is to be raised, alkaline compounds are typically added, such as the alkali metal hydroxides, zinc oxide, zinc carbonate, zinc hydroxide, nickel carbonate, nickel hydroxide, and the like.

In addition to the components which have been noted hereinabove, the chromating baths of the present invention may also contain other components which are typically present in such chromating solutions, as is known in the art. Exemplary of such other components are phosphates, which may be added as phosphoric acid, or in the form of the alkali metal phosphates and acid phosphates and lower carboxylic acids, such as acetic acid or its bath soluble salts. It has been found, however, that the presence of nitrate in the chromating bath or on the surface of the zinc-nickel alloys to be treated tends to inhibit the formation of the desired chromate film on such alloy electrodeposit surfaces. Accordingly, in the practice of the present invention, nitrate-containing compounds are not used in formulating the chromating solutions and the substrates on which the zinc-nickel alloy electrdeposit is formed should not be treated with a nitric acid solution prior to the present chromate treatment.

The present chromating solutions may be applied to the zinc-nickel alloy electrodeposits containing up to about 15% by weight nickel. Generally, such alloy deposits will contain at least about 1% nickel, with nickel contents of from about 5–12% by weight being particularly preferred. Typically, the chromating solutions are applied by immersion of the zinc-nickel alloy electrodeposit in the solution, although other application techniques, such as spraying, flooding, and the like, may also be used. When using such application techniques, the zinc-nickel alloy electrodeposit is maintained in contact with the chromating solution for a period of time sufficient to form the desired chromate film on the surface. In many instances, contact times of from about 10 to about 30 seconds are typical, although this time may be varied in each instance and both shorter and longer contact times may be used to obtain the desired chromate film. The temperature of the chromating bath may be from room temperature, e.g., about 20° C., up to temperatures which approach the boiling point of the solution. Typically, the solution is used at a temperature of from about 25° to about 60° C.

It has been found that the surface of the zinc-nickel alloy electrodeposit may become inactive or inert if it is exposed to the atmosphere for any significant period of time before being subjected to the chromating treatment. In such instances, it has been found desirable to utilize the chromating solutions at higher temperatures, such as about 35° to 55° C., in order to form the desired chromate film. Where the zinc-nickel alloy electrodeposit is treated with the chromating solutions immediately after electrodeposition of the alloy, the lower solution temperatures of 25° to 35° C. may be used to satisfactorily obtain the chromate coating.

In this regard, it has further been found that activation of the zinc-nickel alloy electrodeposit surface may also be accomplished by making the zinc-nickel alloy substrate the anode and electrolyzing the substrate in the chromate solution at a relatively low current density. Typically, the electrolysis, with the zinc-nickel alloy electrodeposit surface as the anode, is carried out at a current density of from about 0.01 to about 0.2 $A/dm^2$ for a period of up to about ten (10) seconds. Thereafter, the zinc-nickel alloy's substrate is retained in the chromating solution, without the application of current, until the desired chromate film is formed on the surface.

It has further been found that in some instances it may be desirable to apply a thin of flash zinc electrodeposit onto the surface of the zinc-nickel alloy electrodeposit prior to treatment in the chromating solutions of the present invention. Such zinc electrodeposits typically will have a thickness of less than about 1 μm and may be obtained by electroplating the zinc-nickel alloy electrodeposit in a zinc plating solution at a current density of from about 0.1 to 3 $A/dm^2$ for up to about five (5) seconds, with electrodeposition times of from about two (2) to three (3) second being typical. Generally, such flash zinc deposits will not be utilized if the substrate to be treated is to be electrolyzed in the chromating solution, but only where the substrate is to be treated by immersion or other similar non-electrolytic treatments in the chromating bath.

By means of the process described hereinabove, zinc-nickel alloy electrodeposits containing up to about 15% by weight nickel are provided with a chromate film having a thickness of at least about 100 mg/m$^2$. These films impart a pleasing color to the alloy surface and provide good corrosion resistance of a magnitude which has heretofore not been possible on zinc-nickel alloy electrodeposits. Moreover, the zinc-nickel alloy electrodeposits containing these chromate films are found to have a corrosion resistance which is superior to that of zinc electrodeposits which have been subject to conventional chromating treatments.

SPECIFIC EXAMPLES OF THE INVENTION

In order that those skilled in the art may better understand the present invention and the manner in which it may be practiced, the following specific examples are given:

EXAMPLE I

An aqueous chromating bath was formulated by dissolving the following components in water in the amounts indicated:

| | |
|---|---|
| $Na_2Cr_2O_7.2H_2O$ | 10 g/l ($Cr^{+6}$ = 3.49 g/l) |
| $H_2SO_4$ | 2 g/l ($SO_4^{-2}$ = 1.96 g/l) |
| | $SO_4^{-2}/Cr^{+6}$ = 0.56 |
| pH | 1.8 |

A steel sheet, electroplated to a thickness of 3 μm with a zinc-nickel alloy containing 8% by weight nickel was chromated with this solution by immersing the sheet in the solution for fifteen (15) seconds at a temperature of 35° C.

EXAMPLE II

An aqueous chromating bath was formulated by dissolving the following components in water in the amounts indicated:

| | |
|---|---|
| $Na_2Cr_2O_7.2H_2O$ | 20 g/l ($Cr^{+6}$ = 6.98 g/l) |
| $ZnSO_4.7H_2O$ | 1 g/l ) $SO_4^{-2}$ = 0.75 g/l) |
| $Cr_2(SO_4)_3$ aqueous solution | 1 g/l ) |
| ($Cr_2(SO_4)_3$ content 40% | ($SO_4^{-2}/Cr^{+6}$ = 0.11) |
| pH | 2.1 (adjusted with $CrO_3$) |

A steel sheet, electroplated to a thickness of 1 μm with a zinc-nickel alloy containing 8% by weight nickel was chromated in this solution by immersing the sheet in the solution for 25 seconds at 50° C.

EXAMPLE III

A chromating bath was formulated by dissolving the following components in water in the amounts indicated:

| | |
|---|---|
| $CrO_3$ | 2 g/l ($Cr^{+6}$ = 1.04 g/l) |
| $H_2SO_4$ | 0.1 g/l ($SO_4^{-2}$ = 0.098 g/l) |
| | ($SO_4^{-2}/Cr^{+6}$ = 0.094) |
| pH | 1.8 |

A steel sheet, electroplated to a thickness of 3 μm with a zinc-nickel alloy containing 8% by weight nickel was chromated by immersing the sheet in the solution for fifteen (15) seconds at a temperature of 40° C.

EXAMPLE IV

An aqueous chromating bath was formulated by dissolving the following components in water in the amounts indicated:

| | |
|---|---|
| $Na_2Cr_2O_7.2H_2O$ | 30 g/l ($Cr^{+6}$ = 11.82 g/l) |
| $ZnSO_4.7H_2O$ | 2 g/l ($SO_4^{-2}$ = 0.96 g/l) |
| $Cr_2(SO_4)_3$ aqueous solution | 1 g/l |
| ($Cr_2(SO_4)_3$ 40% content) | ($SO_4^{-2}/Cr^{+6}$ = 0.081) |
| pH | 2.0 |

A steel sheet, electroplated to a thickness of 2 μm with a zinc-nickel alloy containing 12% by weight nickel was chromated by immersing the sheet in the solution while the solution was electrolyzed at a current density of 0.1 A/dm$^2$ for 5 (five) seconds with the sheet as the anode. After five (5) seconds, the passage of electric current was discontinued and the sheet was retained in the solution for an additional twenty (20) seconds. The temperature of the chromating solution during the entire treatment was 50° C.

EXAMPLE V

An aqueous chromating solution was formulated by dissolving the following components in water in the amounts indicated:

| | |
|---|---|
| $CrO_3$ | 50 g/l ($Cr^{+6}$ = 26.0 g/l) |
| $H_2SO_4$ | 10 g/l ($SO_4^{-2}$ = 9.8 g/l) |
| | ($SO_4^{-2}/Cr^{+6}$ = 0.38) |
| $Na_2HPO_4$ | 2 g/l |
| pH | 1.4 (adjusted with NaOH) |

A steel sheet, electroplated to a thickness of 6 μm with a zinc-nickel alloy having a nickel content of 10% by weight was chromated by immersing the sheet in the chromating bath for ten (10) seconds at a bath temperature of 30° C.

EXAMPLE VI

An aqueous chromating bath was formulated by dissolving the following components in water in the amounts indicated:

| | |
|---|---|
| $Na_2Cr_2O_7.2H_2O$ | 150 g/l ($Cr^{+6}$ = 52.4 g/l) |
| $H_2SO_4$ | 10 g/l ($SO_4^{-2}$ = 9.8 g/l) |
| | ($SO_4^{-2}/Cr^{+6}$ = 0.19) |
| HCOONa | 1.5 g/l |
| pH | 1.6 |

A steel sheet, electroplated to a thickness of 3 μm with a zinc-nickel alloy having a nickel content of 12% by weight, to which had been applied a flash electrodeposit of zinc having a thickness of 0.1 μm was chromated by immersing it in this solution for fifteen (15) seconds at a bath temperature of 30° C.

By way of comparison, the following Examples VII through IX were run.

EXAMPLE VII

An aqueous chromating bath was formulated by dissolving the following components in water in the amounts indicated:

| | |
|---|---|
| $CrO_3$ | 100 g/l ($Cr^{+6}$ = 52.0 g/l) |
| $H_2SO_4$ | 10 g/l ($SO_4^{-2}$ 9.8 g/l) |
| pH | 0.6 ($SO_4^{-2}/Cr^{+6}$ = 0.19) |

A steel sheet, electroplated to a thickness of 3 μm with a zinc-nickel alloy having a nickel content of 10% by weight, was chromated by immersing the sheet in the chromating bath for ten (10) seconds at a bath temperature of 30° C.

EXAMPLE VIII

An aqueous chromating bath was formulated by dissolving the following components in water in the amounts indicated:

| | |
|---|---|
| $CrO_3$ | 10 g/l ($Cr^{+6}$ 5.2 g/l) |
| $H_2SO_4$ | 1 g/l ($SO_4^{-2}/Cr^{+6}$ = 0.98 g/l) |
| pH | 1.2 ($SO_4^{-2}/Cr^{+6}$ = 0.19) |

A steel sheet, electroplated to a thickness of 3 μm with a zinc-nickel alloy having a nickel content of 10% by weight, was chromated by immersing the sheet in the chromating solution for 30 seconds at a bath temperature of 30° C.

EXAMPLE IX

An aqueous chromating bath was formulated by dissolving the following components in water in the amounts indicated:

| | |
|---|---|
| $NaCr_2O_7.2H_2O$ | 10 g/l ($Cr^{+6}$ = 3.49 g/l) |
| $H_2SO_4$ | 1 g/l ($SO_4^{-2}$ = 0.98 g/l) |
| $HNO_3$ | 2 g/l ($SO_4^{-2}/Cr^{+6}$ = 0.28) |
| pH | 1.7 |

A steel sheet, electroplated to a thickness of 4 μm with zinc, was chromated by immersing the sheet in the chromating solution for fifteen (15) seconds at a bath temperature of 30° C.

The chromated samples prepared in accordance with the preceding Examples I through IX were analyzed to determine the chromium content of the chromate coating and were tested for corrosion resistance using the 5% neutral salt spray test and for heat resistance of the chromate coating. The analytical methods and test methods used were as follows:

(1) Analysis of Cr in the chromate film:

Each test specimen was immersed in an aqueous acidic solution containing 100 g/l HCl. The chromate film was completely dissolved from the test specimen and the eluted Cr portion was quantitatively analyzed by atomic absorption spectroscopy. The amount of chromium determined was expressed in terms of the surface area of the test specimen (miligrams per square meter).

(2) Corrosion resistance test:

Each test specimen was subjected to the 5% neutral salt spray test in accordance with the procedure ASTM-B117 and the time was noted for the development of white corrosion products on the surface of the specimen (white rust) and for the development of red corrosion products (red rust) in accordance with this procedure.

(3) Heat resistance test:

Each test specimen was placed in a thermostated oven and maintained in the oven for twenty-four hours at fixed temperatures of 100°, 150°, 200°, and 250° C. Thereafter, each test speciment was removed from the oven and the failure or fading of the chromate film due to the heat was visually observed. Using these procedures, the test results as shown in the following Table I were obtained.

TABLE I

| Example | Zn—Ni Plating (μm) | Test Specimens Chromate Film External Appearance | Cr Amount Adhered ($mg/m^2$) | Salt Water Spray Test: Time to Develop White Rust (hrs) | Salt Water Spray Test: Time to Develop Red Rust (hrs) | Heat Resistance Test Chromate Film Fading Temperature (°C.) |
|---|---|---|---|---|---|---|
| 1 | 3 | Beautiful rainbow-colored interference colors | 230 | 480 | 2,000 | 200–250 |
| 2 | 1 | Beautiful rainbow-colored interference colors | 190 | 432 | " | " |
| 3 | 3 | Beautiful rainbow-colored interference colors | 210 | " | " | " |
| 4 | 2 | Beautiful rainbow-colored interference colors | 190 | " | " | " |
| 5 | 6 | as above (slight green color) | 240 | 480 | " | " |
| 6 | 2 | as above (slight green color) | " | " | " | " |
| 7 | 3 | Yellowish-brown colored poor external | 77 | 120 | 1,032 | 150–200 |

TABLE I-continued

| Example | Zn—Ni Plating (μm) | Test Specimens Chromate Film External Appearance | Cr Amount Adhered ($mg/m^2$) | Salt Water Spray Test: Time to Develop White Rust (hrs) | Salt Water Spray Test: Time to Develop Red Rust (hrs) | Heat Resistance Test Chromate Film Fading Temperature (°C.) |
|---|---|---|---|---|---|---|
| | | appearance | | | | |
| 8 | 3 | Yellowish-brown colored poor external appearance | 35 | 36 | 552 | 100–150 |
| 9 | with zinc 4 | Beautiful rainbow colored interference colors | 280 | 144 | 696 | 100–150 |

Chromated samples produced by Examples II and IX were subjected to the neutral salt spray test after being subjected to the heat resistance test and the following results were obtained:

TABLE II

| Example | Heat Test Temp. (°C.) | Chromate Film Appearance | Time to White Rust (Hours) | Time to Red Rust (Hours) |
|---|---|---|---|---|
| II | 100 | substantially no change | 200 | more than 200 |
| | 150 | substantially no change | 50 | more than 200 |
| | 200 | slightly brownish | 25 | more than 200 |
| | 250 | slightly brownish | 25 | more than 200 |
| IX | 100 | slightly brownish | 50 | 200 |
| | 150 | very brown | 12 | 80 |
| | 200 | whitish | 12 | 72 |
| | 250 | substantially no chromate film remaining | 12 | less than 50 |

EXAMPLE X

A concentrate composition was formulated containing the following components in the amounts indicated:

| | |
|---|---|
| sodium dichromate ($Na_2Cr_2O_7.2H_2O$) | 300 g/l |
| zinc sulfate ($ZnSO_4.7H_2O$) | 15 g/l |
| chromium sulfate ($Cr_2(SO_4)_3$ . . . 40% sol.) | 30 ml/l |
| chromic acid ($CrO_3$) | 40 g/l |
| water | balance |

A chromating solution was formulated by adding the foregoing concentrate solution to water in a amount of 50 mililiters per liter. The pH of this chromating soluton was 1.8 and steel sheets, electroplated to a thickness of 4 μm with a zinc-nickel alloy containing 8.4% by weight nickel, were chromated by immersing the sheets in the chromating solution for 15 seconds while maintaining the bath temperature within the range of 45°–55° C. The results of the testing of the chromate coating produced in accordance with this procedure are found to correspond to the results obtained for Example III.

During the operation of the process of this example, the chromating solution is replenished using a replenishing composition containing the following components in the amounts indicated:

| | |
|---|---|
| chromic acid ($CrO_3$) | 300 g/l |
| sulfuric acid ($H_2SO_4$ 50 wt. %) Sp. Gr. = 1.4 | 100 ml/l |
| water | balance |

The pH and $CrO_3$ concentration of the chromating bath is periodically measured and the above replenishing solution is added in amounts necessary to reestablish the pH and $CrO_3$ content of the bath at the levels originally formulated.

From the foregoing results, it is apparent that the chromating solutions of the present invention provide a colored chromate coating of high quality on zinc-nickel alloy electrodeposits, which chromate coatings have excellent corrosion resistance, as well as heat resistance to color fading. Moreover, the corrosion resistance of the substrate plated with the zinc-nickel alloy electrodeposits and chromated in accordance with the present invention is significantly greater than that of substrates plated with zinc electrodeposits which had been chromated using conventional processes.

What is claimed is:

1. A process for forming a colored chromate film on zinc-nickel alloy electrodeposits containing 5% to about 15% by weight nickel which comprises contacting the said zinc-nickel alloy with a chromating solution comprising at least 0.5 grams per liter hexavalent chromium and sulfate in a weight ratio of $SO_4^{-2}:Cr^{+6}$ of about 0.025–1.5:1, which solution has a pH of from about 1.3 to about 2.7 and is substantially free of nitrate ions, and maintaining the solution in contact with the zinc-nickel alloy for a period of time sufficient to form the desired colored chromate film.

2. The process as claimed in claim 1 wherein the hexavalent chromium content of the chromating solution is from about 0.5 to about 100 grams per liter.

3. The process as claimed in claim 1 wherein the zinc-nickel alloy electrodeposit is immersed in the chromating solution, the solution is electrolyzed, with the zinc-nickel alloy electrodeposit as the anode, for a period of up to about ten seconds at a current density of from about 0.01 to about 0.2 amps per square decimeter, and, thereafter, electrolysis is discontinued and the zinc-nickel alloy electrodeposit is maintained in the chromating solution until the desired colored chromate coating is formed.

4. The process as claimed in claim 3 wherein the hexavalent chromium content of the chromating solution is from about 0.5 to about 100 grams per liter.

* * * * *